US010173118B1

(12) United States Patent
Lawrence

(10) Patent No.: US 10,173,118 B1
(45) Date of Patent: Jan. 8, 2019

(54) FOLDABLE TARGET GAME

(71) Applicant: Gerard Lawrence, West Chester, OH (US)

(72) Inventor: Gerard Lawrence, West Chester, OH (US)

( * ) Notice: Subject to any disclaimer, the term of this patent is extended or adjusted under 35 U.S.C. 154(b) by 0 days.

(21) Appl. No.: 15/814,348

(22) Filed: Nov. 15, 2017

(51) Int. Cl.

| | |
|---|---|
| ***A63B 69/36*** | (2006.01) |
| ***A63B 67/02*** | (2006.01) |
| ***A63B 57/30*** | (2015.01) |
| ***A63B 71/00*** | (2006.01) |
| ***A63B 63/08*** | (2006.01) |
| *A63B 53/00* | (2015.01) |
| *A63B 37/00* | (2006.01) |
| *A63B 57/40* | (2015.01) |
| *A63B 67/00* | (2006.01) |
| *A63B 63/00* | (2006.01) |
| *A63B 67/06* | (2006.01) |

(52) U.S. Cl.
CPC ..... *A63B 67/02* (2013.01); *A63B 57/357* (2015.10); *A63B 63/08* (2013.01); *A63B 71/0036* (2013.01); *A63B 37/0003* (2013.01); *A63B 53/007* (2013.01); *A63B 57/40* (2015.10); *A63B 63/00* (2013.01); *A63B 67/007* (2013.01); *A63B 67/06* (2013.01); *A63B 2209/00* (2013.01); *A63B 2210/54* (2013.01)

(58) Field of Classification Search
CPC ..... A63B 57/357; A63B 57/40; A63B 67/002; A63B 7/06; A63B 63/007; A63B 63/006
USPC ..... 273/398–402; 473/150–197
See application file for complete search history.

(56) References Cited

U.S. PATENT DOCUMENTS

| | | | | |
|---|---|---|---|---|
| 3,104,879 A * | 9/1963 | Jetton | A63B 69/3694 473/153 |
| 3,490,769 A * | 1/1970 | Torbett | A63B 63/007 273/398 |
| 3,578,333 A * | 5/1971 | Elesh | A63B 69/3661 473/171 |
| 5,228,697 A | 7/1993 | Gulick et al. | |
| 5,401,027 A * | 3/1995 | Surbeck | A63B 63/007 273/DIG. 21 |
| 5,782,700 A * | 7/1998 | Haas | A63B 57/357 473/195 |
| 5,830,076 A * | 11/1998 | Borys | A63B 57/40 473/173 |
| D425,957 S * | 5/2000 | Smith | D21/790 |
| 6,083,114 A * | 7/2000 | Bailey | A63B 57/357 473/196 |
| D429,514 S * | 8/2000 | Smith | D21/790 |

(Continued)

*Primary Examiner* — Mark Graham

(57) ABSTRACT

A foldable target game having a circular foldable target having a lip and a pocket continuously disposed on an outer perimeter. A flexible wire ring is disposed within the pocket. The circular foldable target has an open configuration having a first diameter of at least six feet and an alternate folded configuration having a second diameter of most three feet. An inner circle design and a middle circle design are disposed on the circular foldable target. A plurality of tear shaped apertures, a plurality of ovular apertures, a plurality of pie shaped apertures, and a circular aperture are disposed through the circular foldable target. A webbing is disposed on the bottom side of the circular foldable target across each aperture. A telescopable flag pole is planted within the circular aperture. A projectile such as a golf ball is shot onto the target to score points in a game.

4 Claims, 4 Drawing Sheets

(56) References Cited

U.S. PATENT DOCUMENTS

| | | | | |
|---|---|---|---|---|
| 6,241,621 | B1 * | 6/2001 | Maher | A63B 63/007 473/185 |
| 6,409,607 | B1 * | 6/2002 | Libit | A63B 67/02 473/154 |
| 6,419,590 | B1 * | 7/2002 | Criger | A63B 63/007 473/174 |
| 6,569,028 | B1 * | 5/2003 | Nichols | A63B 69/3694 473/153 |
| 6,884,178 | B1 * | 4/2005 | Frost | A63B 67/02 473/150 |
| 6,939,241 | B1 | 9/2005 | Chang | |
| 7,192,360 | B2 | 3/2007 | Tamulewicz | |
| 7,648,421 | B2 * | 1/2010 | Yoon | A63B 63/00 273/400 |
| 7,951,021 | B2 * | 5/2011 | Lessack | A63B 63/007 273/400 |
| 2015/0087433 | A1 * | 3/2015 | Roberts | A63B 67/02 473/195 |

* cited by examiner

FOLDABLE TARGET GAME

BACKGROUND OF THE INVENTION

Various types of target games are known in the prior art. What is needed, and what the present foldable target game provides, is a circular foldable target having a plurality of tear shaped pockets, a plurality of ovular pockets, a plurality of pie shaped pockets, a circular pocket, and a star design, wherein each of the plurality of pockets has a webbing. What is also needed is a lip around an outer perimeter of the circular foldable target, as well as a flexible wire frame disposed within a pocket continuously disposed on the outer perimeter.

FIELD OF THE INVENTION

The present invention relates to lawn games, and more particularly, to a foldable target game.

SUMMARY OF THE INVENTION

The general purpose of the present foldable target game, described subsequently in greater detail, is to provide a foldable target game that has many novel features that result in a foldable target game that is not anticipated, rendered obvious, suggested, or even implied by prior art, either alone or in combination thereof.

To accomplish this, the present foldable target game includes a circular foldable target having a center, a top side, a bottom side, a lip continuously disposed on an outer perimeter, and a pocket continuously disposed on the outer perimeter. A flexible wire ring is disposed within the pocket. A plurality of tabs is disposed on the outer perimeter. Each of the plurality of tabs is evenly spaced on the outer perimeter. It is preferred that the plurality of tabs is three, spaced at 120° intervals.

The circular foldable target has an open configuration and an alternate folded configuration. In the open configuration, the circular foldable target has a first diameter of at least six feet, and preferably eight feet. In the alternate folded configuration, the circular foldable target has a second diameter of at most three feet. An inner circle design is disposed on the top side of the circular foldable target, and a middle circle design is medially disposed on the top side of the circular foldable target between the inner circle design and the outer perimeter. The outer perimeter, the middle circle design, and the inner circle design are concentric. A plurality of tear shaped apertures is disposed from the top side of the circular foldable target to the bottom side of the circular foldable target between the middle circle design and the outer perimeter thereof. A plurality of ovular apertures is disposed from the top side of the circular foldable target to the bottom side of the circular foldable target between the inner circle design and the middle circle design thereof. A circular aperture is disposed from the top side of the circular foldable target to the bottom side of the circular foldable target within the inner circle design. The circular aperture is approximately the same diameter as a standard golf hole. A telescopable flag pole has a compacted position having a first length of 1.5 feet at most, and an alternate extended position having a second length of 4 feet at most. The telescopable flag pole is configured to be planted in a grass lawn within the circular aperture such that it stands perpendicular to a plane of the circular foldable target.

A preferred embodiment of the invention also includes a star design centrally disposed on the top side of the circular foldable target, wherein the star design has a plurality of points each extending to a terminus between the inner circle design and the middle circle design. The plurality of points of the star design and the inner circle design intersect to create a plurality of pie shaped designs there between. There is a plurality of pie shaped apertures disposed from the top side of the circular foldable target to the bottom side of the circular foldable target, wherein each of the pie shaped apertures is disposed within each of the plurality of pie shaped designs. A webbing is disposed on the bottom side of the circular foldable target across each of the plurality of tear shaped apertures, the plurality of ovular apertures, the circular aperture, and the plurality of pie shaped apertures. The webbing adds stiffness to the circular foldable target, and also helps trap a projectile shot onto the circular foldable target. There is a circular bag having a zippered aperture, a pair of handles, and an outside pocket, wherein the zippered aperture is configured to receive the circular foldable target in the alternate folded configuration.

The folding target game is configured to be played with projectiles including, but not limited to, golf balls, lawn darts, and bean bags. A plurality of point values can be assigned to each of a first area within the inner circle, a second area between the inner circle and the middle circle, a third area between the middle circle and the outer perimeter, the circular aperture, the plurality of pie shaped apertures, the plurality of ovular apertures, and the plurality of tear shaped apertures. The lip is configured to keep the projectiles from rolling off of the folding target game.

Thus have been broadly outlined the more important features of the present foldable target game so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
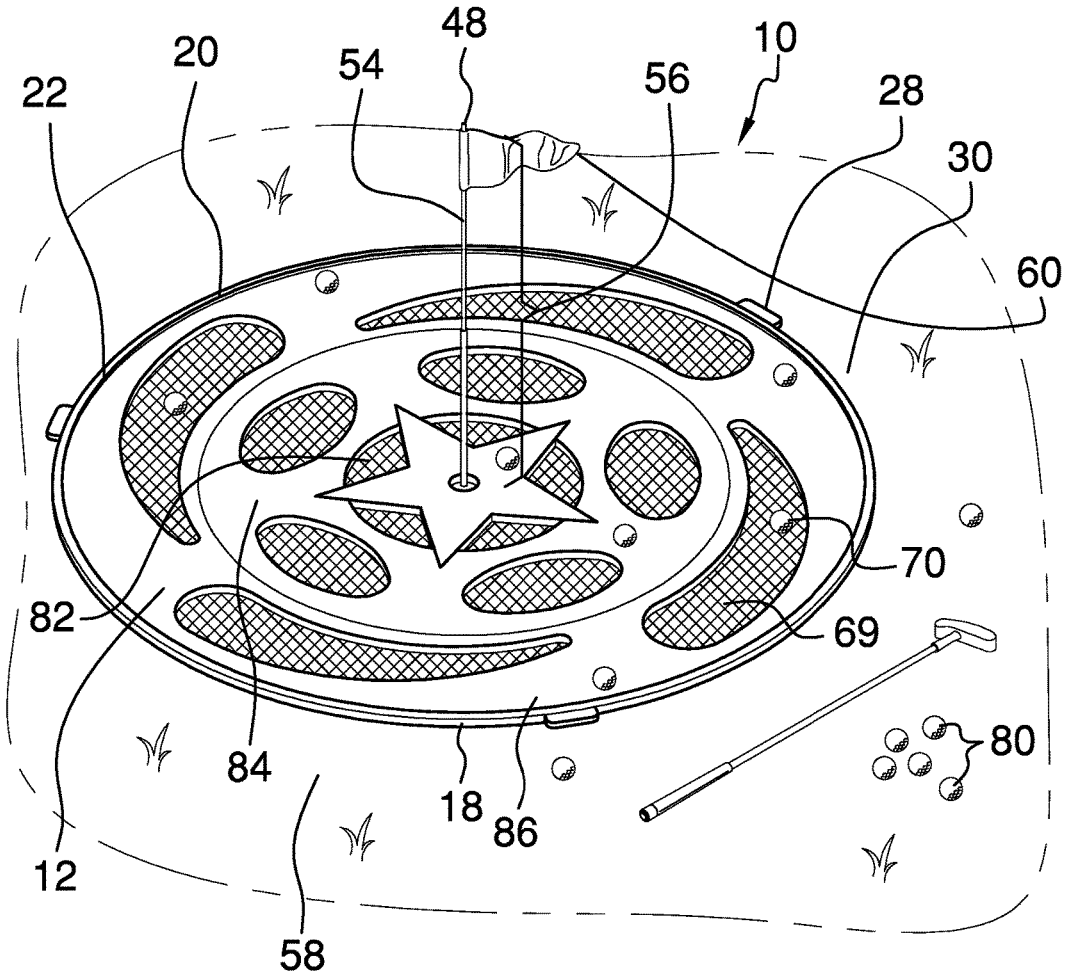
FIG. 1 is an isometric in-use view of the foldable target game, a golf club, and a plurality of golf balls.
Figure 2:
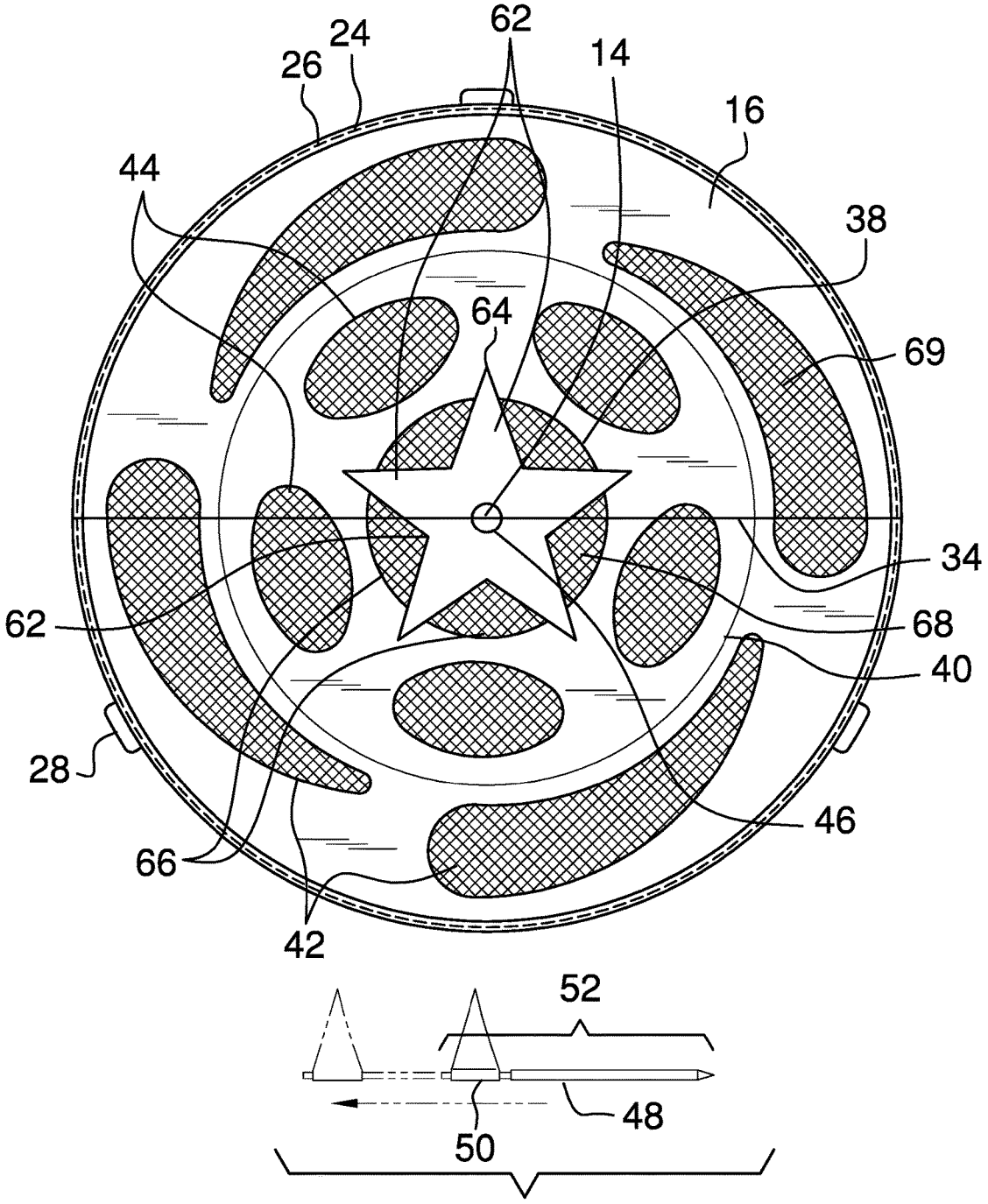
FIG. 2 is a top plan view of the foldable target game.
Figure 3:
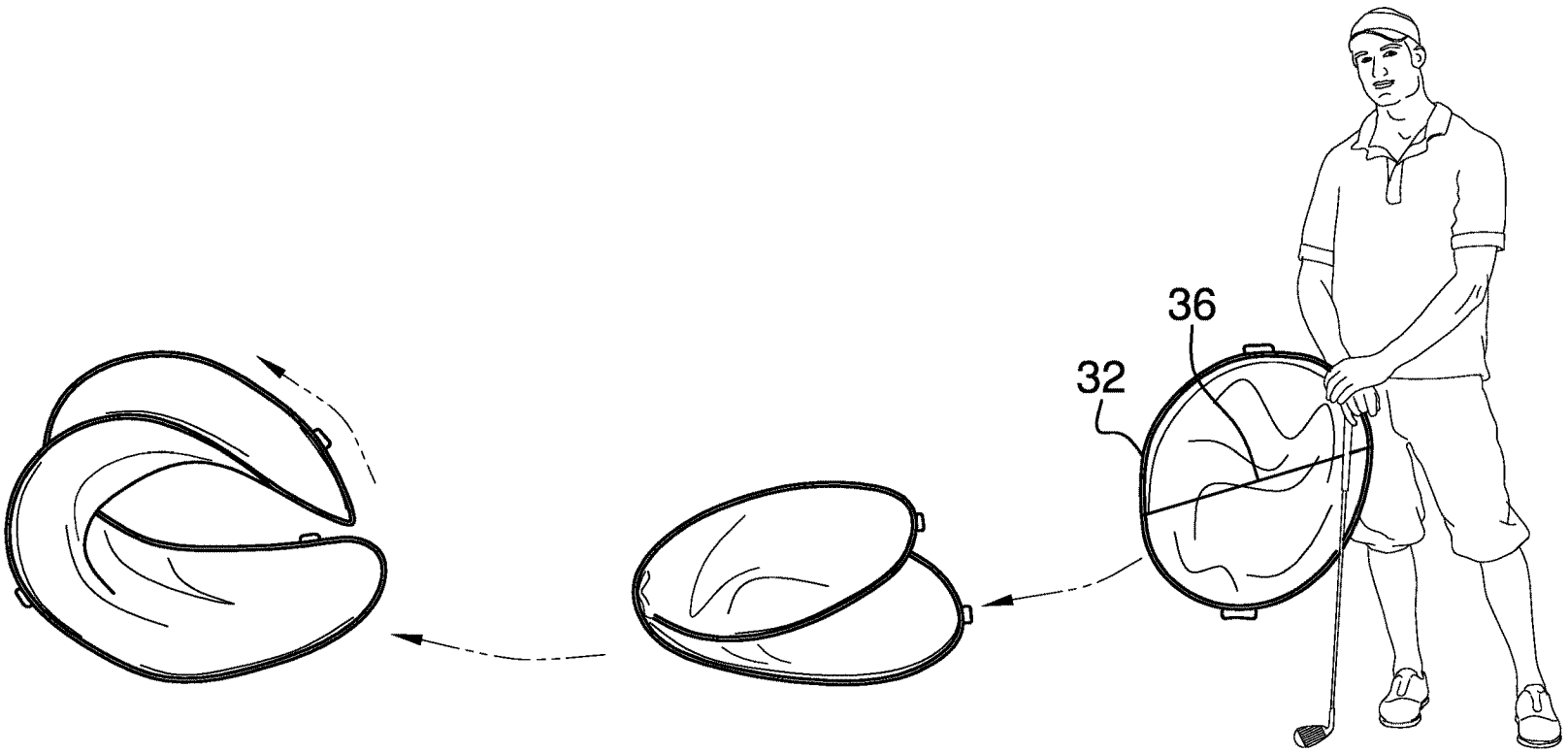
FIG. 3 is an isometric in-use view of the foldable target game moving from the alternate folded configuration to the open configuration.
Figure 4:
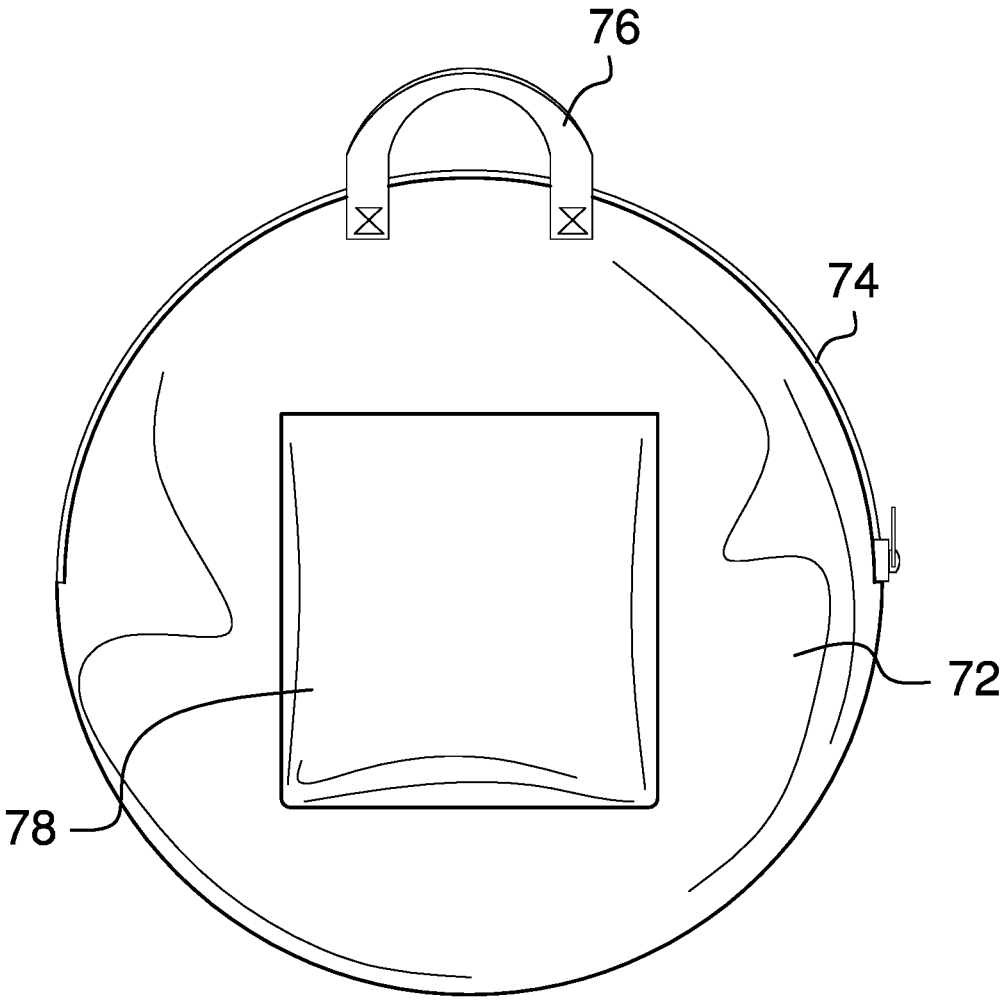
FIG. 4 is a front view of the foldable target game inside of the circular bag.

With reference now to the drawings, and in particular FIGS. 1 through 4 thereof, an example of the instant foldable target game employing the principles and concepts of the present foldable target game and generally designated by the reference number 10 will be described.

Referring to FIGS. 1 through 4 the present foldable target game 10 is illustrated. The foldable target game 10 includes a circular foldable target 12 having a center 14, a top side 16, a bottom side 18, a lip 20 continuously disposed on an outer perimeter 22, and a pocket 24 continuously disposed on the outer perimeter. A flexible wire ring 26 is disposed within the pocket 24. A plurality of tabs 28 is disposed on the outer perimeter 22. Each of the plurality of tabs is evenly spaced on the outer perimeter.

The circular foldable target 12 has an open configuration 30 and an alternate folded configuration 32. In the open configuration 30, the circular foldable target has a first diameter 34. In the alternate folded configuration 32, the circular foldable target has a second diameter 36. An inner circle design 38 is disposed on the top side 16 of the circular foldable target, and a middle circle design 40 is medially disposed on the top side of the circular foldable target between the inner circle design 38 and the outer perimeter 22. The outer perimeter, the middle circle design, and the inner circle design are concentric. A plurality of tear shaped apertures 42 is disposed from the top side 16 of the circular foldable target to the bottom side 18 of the circular foldable target between the middle circle design 40 and the outer perimeter 22 thereof. A plurality of ovular apertures 44 is disposed from the top side of the circular foldable target to the bottom side of the circular foldable target between the inner circle design 38 and the middle circle design 40 thereof. A circular aperture 46 is disposed from the top side of the circular foldable target to the bottom side of the circular foldable target within the inner circle design 38. A telescopable flag pole 48 has a compacted position 50 having a first length 52, and an alternate extended position 54 having a second length 56. The telescopable flag pole is configured to be planted in a grass lawn 58 within the circular aperture 46 such that it stands perpendicular to a plane 60 of the circular foldable target.

A preferred embodiment of the invention also includes a star design 62 centrally disposed on the top side of the circular foldable target, wherein the star design has a plurality of points 62 each extending to a terminus 64 between the inner circle design 38 and the middle circle design 40. The plurality of points of the star design and the inner circle design intersect to create a plurality of pie shaped designs 66 there between. There is a plurality of pie shaped apertures 68 disposed from the top side of the circular foldable target to the bottom side of the circular foldable target, wherein each of the pie shaped apertures is disposed within each of the plurality of pie shaped designs 66. A webbing 69 is disposed on the bottom side 18 of the circular foldable target across each of the plurality of tear shaped apertures 42, the plurality of ovular apertures 44, the circular aperture 46, and the plurality of pie shaped apertures 68. The webbing adds stiffness to the circular foldable target, and also helps trap a projectile 70 shot onto the circular foldable target 12. There is a circular bag 72 having a zippered aperture 74, a pair of handles 76, and an outside pocket 78, wherein the zippered aperture is configured to receive the circular foldable target 12 in the alternate folded configuration.

The folding target game is configured to be played with projectiles including, but not limited to, a plurality of golf balls 80. A plurality of point values can be assigned to each of a first area 82 within the inner circle, a second area 84 between the inner circle and the middle circle, a third area 86 between the middle circle and the outer perimeter, the circular aperture 46, the plurality of pie shaped apertures 68, the plurality of ovular apertures 44, and the plurality of tear shaped apertures 42. The lip 20 is configured to keep the plurality of golf balls 80 from rolling off of the folding target game.

What is claimed is:

1. A foldable target game comprising:

a circular foldable target having a center, a top side, a bottom side, a lip continuously disposed on an outer perimeter, a pocket continuously disposed on the outer perimeter, an inner circle design disposed on the top side of the circular foldable target, and a middle circle design medially disposed on the top side of the circular foldable target between the inner circle design and the outer perimeter, wherein the outer perimeter, the middle circle design, and the inner circle design are concentric, wherein the circular foldable target has an open configuration having a first diameter and an alternate folded configuration having a second diameter;

a flexible wire ring disposed within the pocket;

a plurality of tabs disposed on the outer perimeter;

a plurality of tear shaped apertures disposed from the top side of the circular foldable target to the bottom side of the circular foldable target between the middle circle design and the outer perimeter thereof;

a plurality of ovular apertures disposed from the top side of the circular foldable target to the bottom side of the circular foldable target between the inner circle design and the middle circle design thereof;

a circular aperture disposed from the top side of the circular foldable target to the bottom side of the circular foldable target within the inner circle design;

a telescopable flag pole having a compacted position having a first length, and an alternate extended position having a second length, wherein the telescopable flag pole is configured to be disposed within the circular aperture; and a circular bag having a zippered aperture, a pair of handles, and an outside pocket, wherein the zippered aperture is configured to receive the circular foldable target in the alternate folded configuration.

2. The foldable target game of claim 1 further comprising a webbing disposed on the bottom side of the circular foldable target across each of the plurality of tear shaped apertures, the plurality of ovular apertures, and the circular aperture.

3. The foldable target game of claim 1 further comprising:

a star design centrally disposed on the top side of the circular foldable target, wherein the star design has a plurality of points each extending to a terminus between the inner circle design and the middle circle design, wherein the plurality of points of the star design and the inner circle design intersect to create a plurality of pie shaped designs there between; and a plurality of pie shaped apertures disposed from the top side of the circular foldable target to the bottom side of the circular foldable target, wherein each of the pie shaped apertures is disposed within each of the plurality of pie shaped designs.

4. The foldable target game of claim 3 further comprising a webbing disposed on the bottom side of the circular foldable target across each of the plurality of tear shaped apertures, the plurality of ovular apertures, and the circular aperture.

* * * * *